US010635027B2

(12) United States Patent
Ohkubo

(10) Patent No.: US 10,635,027 B2
(45) **Date of Patent: *Apr. 28, 2020**

(54) IMAGE FORMING APPARATUS

(71) Applicant: CANON KABUSHIKI KAISHA, Tokyo (JP)

(72) Inventor: Takateru Ohkubo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/938,219

(22) Filed: Mar. 28, 2018

(65) Prior Publication Data

US 2018/0217527 A1 Aug. 2, 2018

Related U.S. Application Data

(63) Continuation of application No. 15/375,451, filed on Dec. 12, 2016, now Pat. No. 9,964,898.

(30) Foreign Application Priority Data

Dec. 28, 2015 (JP) ..... 2015-256688

(51) Int. Cl.
*G03G 15/16* (2006.01)
*G03G 21/16* (2006.01)
*G03G 21/18* (2006.01)

(52) U.S. Cl.
CPC ..... *G03G 15/161* (2013.01); *G03G 21/1619* (2013.01); *G03G 21/185* (2013.01)

(58) Field of Classification Search
CPC ..... G03G 15/161; G03G 21/10; G03G 21/12; G03G 21/169; G03G 2215/1647
See application file for complete search history.

(56) References Cited

U.S. PATENT DOCUMENTS 6,704,528 B1 3/2004 Kawamura et al.
8,195,075 B2 6/2012 Yoshinaga et al.
(Continued)

FOREIGN PATENT DOCUMENTS

CN 101145018 A 3/2008
CN 102566356 A 7/2012
(Continued)

OTHER PUBLICATIONS

Search Report dated Jun. 15, 2017, in Great Britain Patent Application No. 1621232.6.
(Continued)

*Primary Examiner* — Thomas S Giampaolo, II
(74) *Attorney, Agent, or Firm* — Venable LLP

(57) ABSTRACT

An image forming apparatus including a cleaning unit removably mountable to an apparatus main body under a state of being supported by a transfer unit, and movable with respect to the transfer unit in a longitudinal direction of a cleaning member under a state of not being mounted to the apparatus main body. The apparatus main body includes a frame unit portion configured to position a cartridge with respect to the apparatus main body in an axial direction of a photosensitive drum. The frame unit portion is configured to position the cleaning member with respect to the apparatus main body in the longitudinal direction under a state in which the transfer unit is mounted to the apparatus main body.

32 Claims, 7 Drawing Sheets

(56) References Cited

U.S. PATENT DOCUMENTS

| | | | | |
|---|---|---|---|---|
| 8,824,919 | B2 | 9/2014 | Kikuchi | |
| 9,964,898 | B2 * | 5/2018 | Ohkubo | G03G 15/161 |
| 2001/0051059 | A1 | 12/2001 | Morikami et al. | |
| 2006/0072929 | A1 * | 4/2006 | Takahashi | G03G 21/1647 399/13 |
| 2006/0216057 | A1 | 9/2006 | Fukao | |
| 2009/0123178 | A1 | 5/2009 | Suzuki et al. | |
| 2013/0322934 | A1 | 12/2013 | Hatano | |
| 2014/0153946 | A1 * | 6/2014 | Kobayashi | G03G 15/1605 399/66 |

FOREIGN PATENT DOCUMENTS

| | | | |
|---|---|---|---|
| EP | 1637937 | A2 | 3/2006 |
| JP | 2001-75374 | A | 3/2001 |
| JP | 2004-050671 | A | 2/2004 |
| JP | 3815139 | B2 | 8/2006 |
| JP | 2006-301545 | A | 11/2006 |
| JP | 2007-93905 | A | 4/2007 |
| JP | 2010-204250 | A | 9/2010 |
| JP | 2015-062075 | A | 4/2015 |

OTHER PUBLICATIONS

Office Action dated Apr. 23, 2019, in Korean Patent Application No. 10-2016-0174563.
Office Action dated Jul. 3, 2019, in Chinese Patent Application No. 201611201949.3.
Office Action dated Nov. 5, 2019, in Japanese Patent Application No. 2018-171644.

* cited by examiner

IMAGE FORMING APPARATUS

This is a continuation of U.S. patent application Ser. No. 15/375,451, filed Dec. 12, 2016.

BACKGROUND OF THE INVENTION

Field of the Invention

The present invention relates to an image forming apparatus, which includes a transfer unit including a belt configured to transfer a toner image from an image bearing member onto a transfer material and a cleaning unit configured to remove residual toner on the belt.

Description of the Related Art

In Japanese Patent No. 3815139, there is disclosed an image forming apparatus, which includes an image forming unit including an image bearing member configured to bear a toner image and a transfer unit including a belt configured to transfer the toner image from the image bearing member onto a transfer material. According to the configuration of Japanese Patent No. 3815139, residual toner on the belt is removed by a cleaning member.

In recent years, further downsizing is demanded of image forming apparatuses. Further downsizing is also demanded for a cleaning unit. In order to downsize the cleaning unit, the longitudinal width of a cleaning member needs to be reduced. However, the longitudinal width of the cleaning member needs to be larger than the longitudinal width of a developing member of an image forming unit. When this relationship is not satisfied, a toner image which cannot be removed may remain on a belt of a transfer unit and cause an image defect. Thus, in order to reduce the longitudinal width of the cleaning member of the cleaning unit, a relative positional relationship with the image forming unit needs to be determined with high accuracy.

However, according to Japanese Patent No. 3815139, the cleaning unit is positioned and fixed with respect to the transfer unit, and the image forming unit is fixed to an apparatus main body. Thus, a plurality of components are interposed between the cleaning member, which is a key component of the cleaning unit, and the image forming unit. That is, components such as the apparatus main body of the image forming apparatus, the transfer unit, and a casing of the cleaning unit are interposed, with the result that dimensional tolerances and mounting errors of those components in the longitudinal direction are imposed. Therefore, the longitudinal width of the cleaning member needs to be determined in consideration of those errors, and there is difficulty in reducing the longitudinal width of the cleaning member.

SUMMARY OF THE INVENTION

According to the present invention there is provided an image forming apparatus including an apparatus main body, a cartridge being removably mountable to the apparatus main body and including a photosensitive drum configured to bear a toner image, a transfer unit being removably mountable to the apparatus main body and including a belt configured to transfer the toner image from the photosensitive drum onto a transfer material, a cleaning unit being removably mountable to the apparatus main body and including a cleaning member configured to remove residual toner on the belt, the cleaning unit supported by the transfer unit in a state of being mounted to the apparatus main body and being movable with respect to the transfer unit in a longitudinal direction of the cleaning member in a state of being not mounted to the apparatus main body, and a frame unit portion of the apparatus main body, which is configured to position the cartridge with respect to the apparatus main body in an axial direction of the photosensitive drum, wherein the frame unit portion is configured to position the cleaning member with respect to the apparatus main body in the longitudinal direction in a state where the transfer unit is mounted to the apparatus main body.

Further features of the present invention will become apparent from the following description of exemplary embodiments with reference to the attached drawings.

DESCRIPTION OF THE EMBODIMENTS

Figure 1:
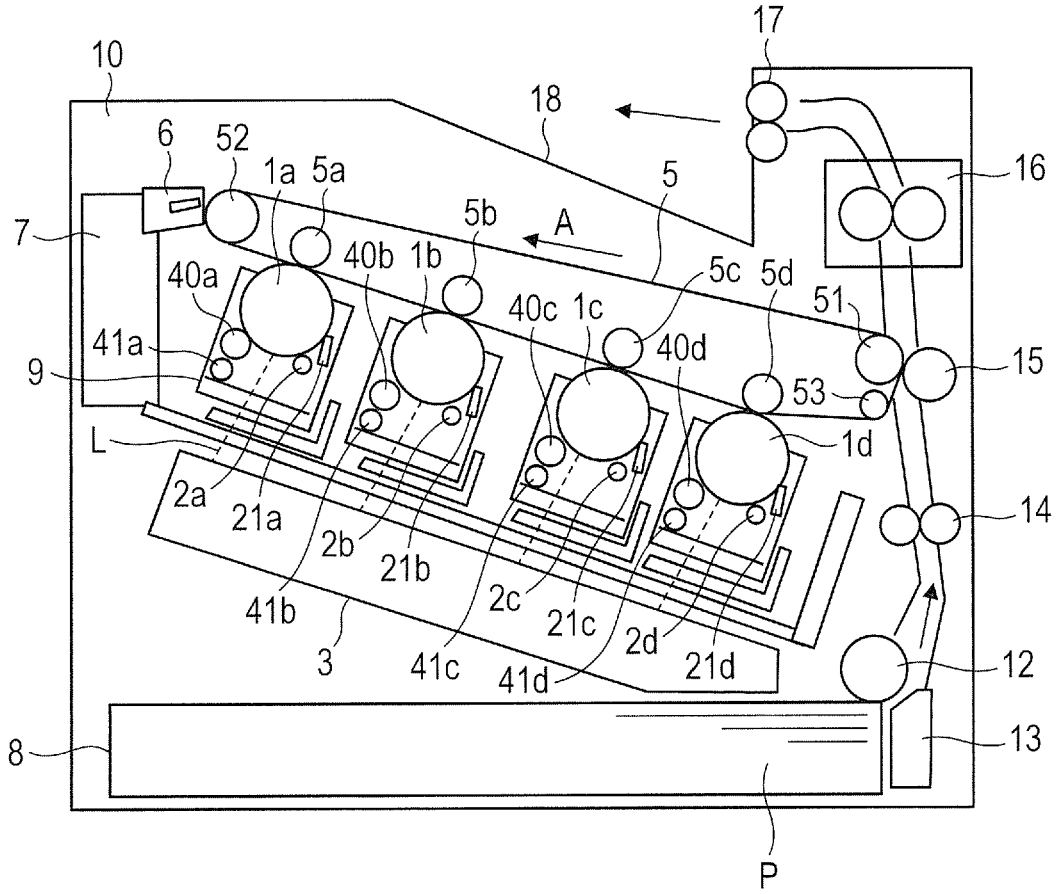
FIG. 1 is a schematic sectional view of an image forming apparatus according to a first embodiment of the present invention.

Now, the present invention is described in detail based on embodiments illustrated in the drawings.

First Embodiment

FIG. 1 is a schematic sectional view for illustrating a configuration of an image forming apparatus according to a first embodiment of the present invention. In the first embodiment, a color laser beam printer is described as an example of the image forming apparatus.

That is, the image forming apparatus includes a plurality of process cartridges 9 serving as image forming units, an intermediate transfer unit 5*u* including an intermediate transfer belt 5, and a cleaning unit 6 configured to remove residual toner on the intermediate transfer belt 5. The process cartridges 9 include photosensitive drums 1 serving as image bearing members configured to bear toner images. The intermediate transfer belt 5 of the intermediate transfer unit 5*u* is a belt configured to transfer the toner images from the photosensitive drums 1 onto a transfer material P.

In this embodiment, in order to form toner images of four different colors, four process cartridges 9 are arranged in parallel. The four process cartridges 9 have the same configuration. Thus, in the following description, the process cartridges and components thereof are denoted by reference symbols having suffixes a, b, c, and d added thereto.

The process cartridges 9*a* to 9*d* include developing rollers 40*a* to 40*d* serving as developing members configured to supply toner to the photosensitive drums 1*a* to 1*d* serving as image bearing members, and are arranged in parallel with each other at a center portion of an apparatus main body 10 in the right and left directions of FIG. 1.

The intermediate transfer belt 5 is an endless belt which is stretched around a pair of support rollers 51 and 52 located at both right and left ends. The intermediate transfer belt 5 is driven to rotate in the direction of the arrow A (counter-clockwise direction in FIG. 1) under a state in which tension is applied by a tension roller 53. Although illustration is omitted in FIG. 1, the support rollers 51 and 52 and the tension roller 53 are arranged between a pair of side plates supporting the rollers. The intermediate transfer belt 5 is positioned above the photosensitive drums 1*a* to 1*d* of the process cartridges 9*a* to 9*d*. A running surface of the intermediate transfer belt 5 on a lower side is held in contact with respective circumferential surfaces of the photosensitive drums 1*a* to 1*d*.

Further, a secondary transfer roller 15 is arranged opposed to the support roller 51 on one side of the intermediate transfer belt 5 (right end in FIG. 1), and the cleaning unit 6 is arranged opposed to the support roller 52 on another end (left end in FIG. 1). For example, the support roller 51 opposed to the secondary transfer roller 15 is a driving roller, and the support roller 52 is a driven roller.

The cleaning unit 6 includes a cleaning brush 6*br* configured to remove residual toner on the intermediate transfer belt 5.

The toner images of different colors formed on the photosensitive drums 1*a* to 1*d* of the process cartridges 9*a* to 9*d* are primarily transferred onto the intermediate transfer belt 5 so as to be sequentially superimposed by primary transfer rollers 5*a* to 5*d* arranged in the intermediate transfer belt 5. After that, a toner image on the intermediate transfer belt 5 is secondarily transferred onto the transfer material P serving as a recording material by the secondary transfer roller 15 opposed to the support roller 51 on one side. With this, an output image is obtained.

Now, an image forming operation of the image forming apparatus of this embodiment is described in more detail.

When a print signal is transmitted from a controller (not shown) to drive the image forming apparatus, charging rollers 2*a* to 2*d* having voltage applied thereto uniformly charge the surfaces of the photosensitive drums 1*a* to 1*d* prior to latent image formation. A laser light L emitted from a laser scanner 3 is radiated to the charged surfaces of the photosensitive drums 1*a* to 1*d*. With this, electrostatic latent images for respective colors are formed. Then, developer application rollers 41*a* to 41*d* and the developing rollers 40*a* to 40*d* supply toner to the electrostatic latent images formed on the photosensitive drums 1*a* to 1*d*. With this, the electrostatic latent images are visualized as toner images.

The toner images of respective colors developed on the photosensitive drums 1*a* to 1*d* are primarily transferred in a sequential manner by the primary transfer rollers 5*a* to 5*d*, which are opposed to the photosensitive drums 1*a* to 1*d* over the intermediate transfer belt 5, onto the intermediate transfer belt 5 rotating in the direction of the arrow A. With this, the toner image is formed. The primary transfer of the toner images is performed through application of transfer voltage by the primary transfer rollers 5*a* to 5*d*.

Meanwhile, transfer materials P stacked and stored in a transfer material storage portion 8 arranged in a lower part of the apparatus main body 10 are separated into individual sheets and fed by a sheet feeding roller 12 and a separating portion 13. The transfer material P having been fed is conveyed to a position between the intermediate transfer belt 5 and the secondary transfer roller 15 at a predetermined timing by a registration roller pair 14. At this time, a secondary transfer voltage is applied to the secondary transfer roller 15, and the toner image preliminarily formed on the intermediate transfer belt 5 is secondarily transferred onto the transfer material P.

The transfer material P having the toner image secondarily transferred thereon is conveyed to a further upper side and passes through a fixing device 16, and the toner image on the transfer material P receives heat and pressure to be fixed. After that, the transfer material P is delivered by a delivery roller pair 17 to a delivery tray 18 arranged on an outer side of a casing of the apparatus main body 10.

Meanwhile, toner having remained on the surfaces of the photosensitive drums 1*a* to 1*d* after the transfer of the toner images is removed by cleaning blades 21*a* to 21*d*. Further, toner having remained on the intermediate transfer belt 5 after the secondary transfer to the transfer material P is controlled by the cleaning brush 6*br*, which is arranged in the cleaning unit 6, to have uniform toner polarity and caused to electrostatically adhere to the photosensitive drum 1*a*, thereby being removed by the cleaning blade 21*a* arranged in the process cartridge 9. The toner removed in the process cartridge 9 which is connected to a waste toner conveyance passage (not shown), passes therethrough and is collected into a waste toner collection container 7.

The apparatus main body 10 has front, rear, right, and left surfaces, and includes, in the front surface, a front door Fd serving as a first opening and closing portion for allowing the process cartridges 9 to be removably mounted. Further, the apparatus main body 10 includes, in the right side surface which is substantially orthogonal to the front surface of the apparatus main body 10, a right door Rd serving as a second opening and closing portion for allowing the intermediate transfer unit 5*u* to be removably mounted.

Figure 2A:
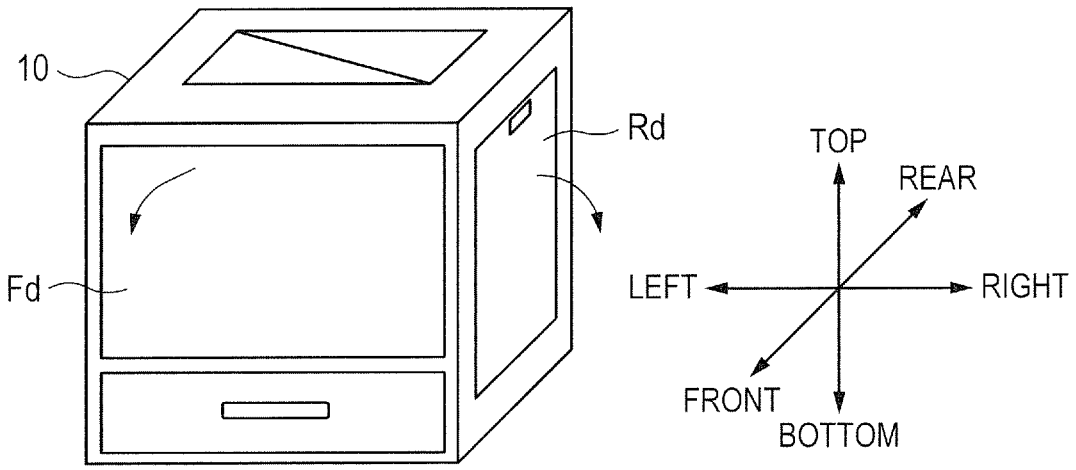
FIG. 2A and FIG. 2B are schematic perspective views of the image forming apparatus of FIG. 1.
Figure 2B:
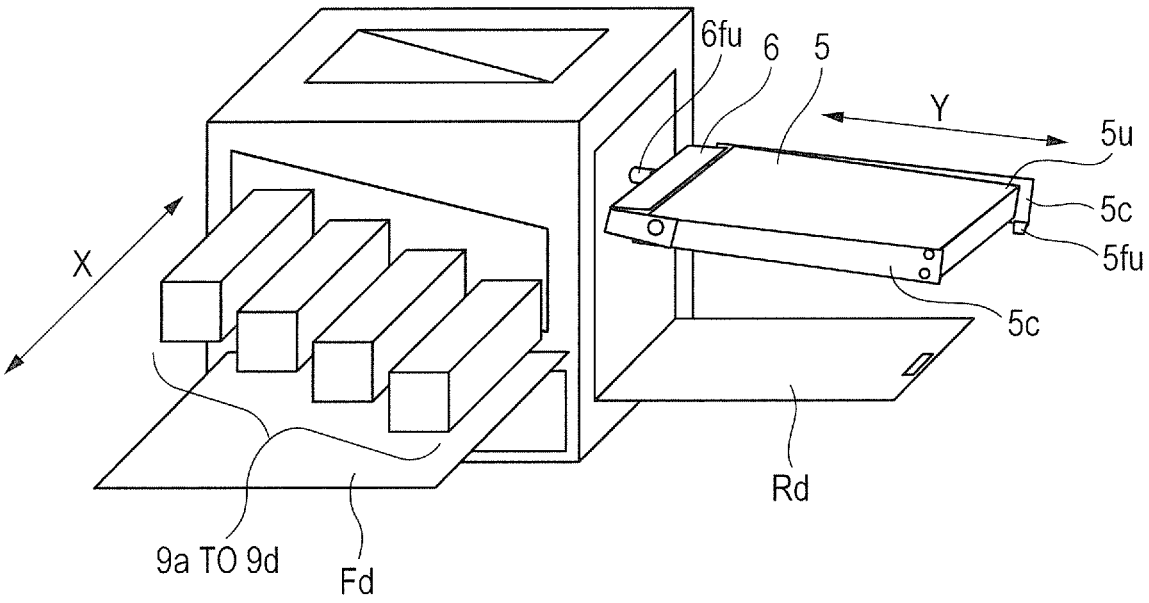

As illustrated in FIG. 2A and FIG. 2B, the process cartridges 9 can be removably mounted from the front side of the apparatus main body 10 in a first direction X parallel to a longitudinal direction of the developing rollers 40*a* to 40*d* by opening the front door Fd toward the front side of the apparatus main body 10. The first direction X is the longitudinal direction of each of the process cartridges 9, that is, the front and rear directions in FIG. 2A and FIG. 2B along axes of the photosensitive drums 1*a* to 1*d* and the developing rollers 40*a* to 40*d*. Meanwhile, the intermediate transfer unit 5*u* can be removably mounted together with the cleaning unit 6 from the right side in a second direction Y by opening the right door Rd, which is arranged on the right side surface oriented in a direction different from the front direction of the apparatus main body 10 by approximately 90°. The second direction Y is a direction orthogonal to the first direction X (front and rear directions) and along the running surface of the intermediate transfer belt 5. The second direction Y is slightly inclined with respect to the right and left directions.

Next, detailed description is made of a feature of the present invention, that is, a configuration of positioning the process cartridges 9, the intermediate transfer unit 5*u*, and the cleaning unit 6 with respect to the apparatus main body 10. As described above, the cleaning unit 6 is configured to remove the toner image having remained on the intermediate transfer belt 5 without being transferred.

Further, the cleaning unit 6 is supported by the intermediate transfer unit 5*u*, but is movable with respect to the intermediate transfer unit 5*u* in the longitudinal direction under a state of not being mounted to the apparatus main body 10.

With regard to the toner images to be transferred onto the intermediate transfer belt 5, toner is supplied by the developer application rollers 41*a* to 41*d* and the developing rollers 40*a* to 40*d* to the electrostatic latent images formed on the photosensitive drums 1*a* to 1*d*, and hence the toner images are visualized on the surfaces.

However, there is a case where toner borne on the developing rollers 40*a* to 40*d* is minutely transferred onto the photosensitive drums 1*a* to 1*d* by a force other than the electrostatic force, such as contact pressure, and it may be assumed that such toner is transferred onto the intermediate transfer belt 5. Therefore, the cleaning unit 6 needs to have a width which enables removal of such a minute amount of toner.

That is, in order to remove the toner having remained on the intermediate transfer belt 5 without being transferred, a width of the cleaning brush 6*br* of the cleaning unit 6 needs to be larger than the width of each of the developing rollers 40*a* to 40*d*. When the width of the developing rollers 40*a* to 40*d* is Ld, and the width of the cleaning brush 6*br* in the cleaning unit 6 is Lb, a relationship of Ld<Lb needs to be satisfied.

Figure 3B:
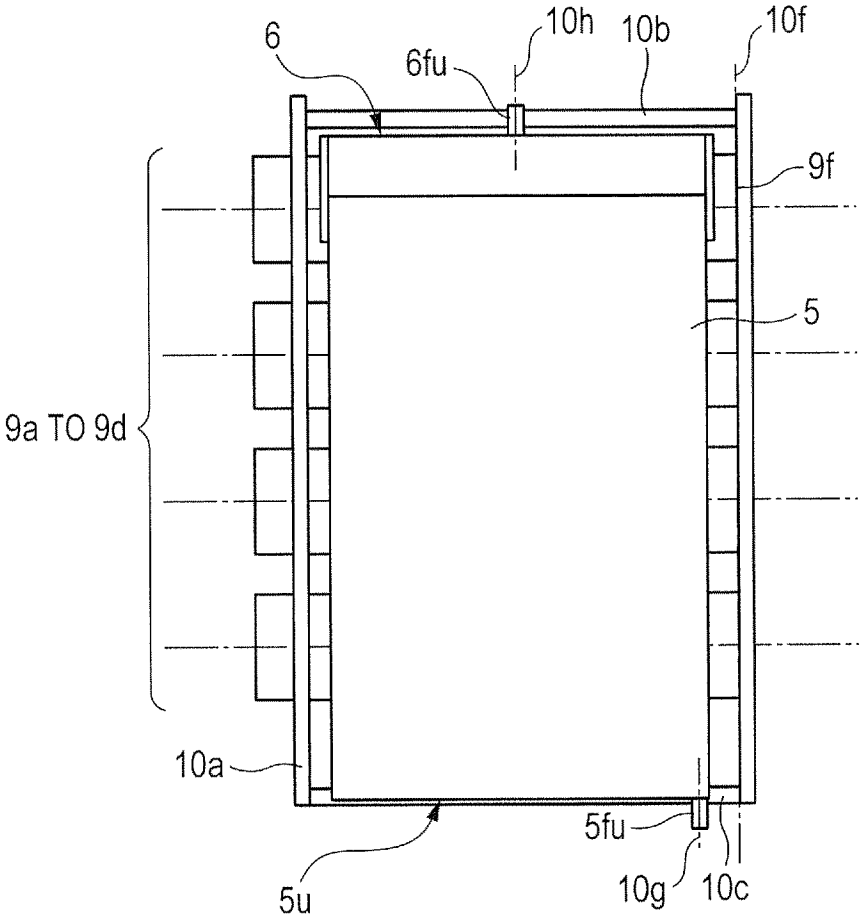
FIG. 3A and FIG. 3B are plan views for illustrating a relationship of positioning portions for an image process unit, an intermediate transfer belt, and a belt cleaning device according to the first embodiment.
Figure 3A:
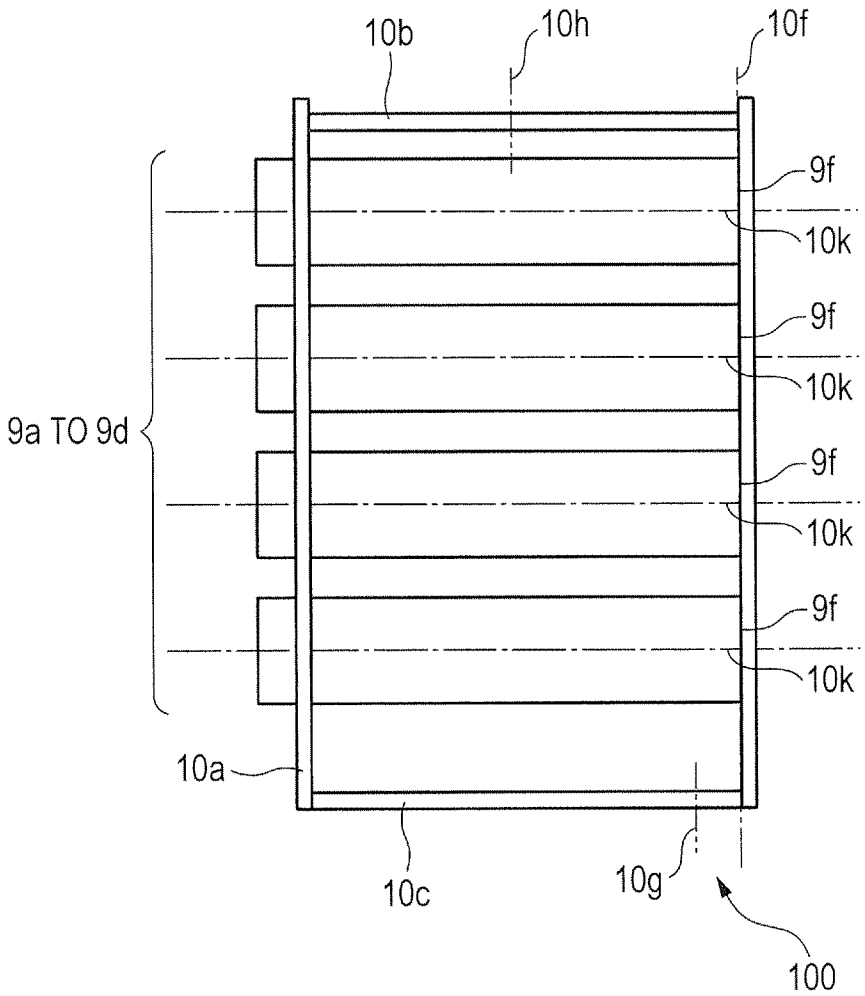

FIG. 3A and FIG. 3B are schematic views for illustrating a positional relationship between the process cartridges 9, which are to be mounted and positioned in the apparatus main body 10 illustrated in FIG. 1, and the cleaning unit 6 assembled to the intermediate transfer unit 5*u*. That is, FIG. 3A is a view for illustrating the process cartridges 9 mounted to the apparatus main body 10 as viewed from an upper side of FIG. 1. FIG. 3B is a view for illustrating a state in which the intermediate transfer unit 5*u* and the cleaning unit 6 are placed above the process cartridges 9 of FIG. 3A.

Figure 4:
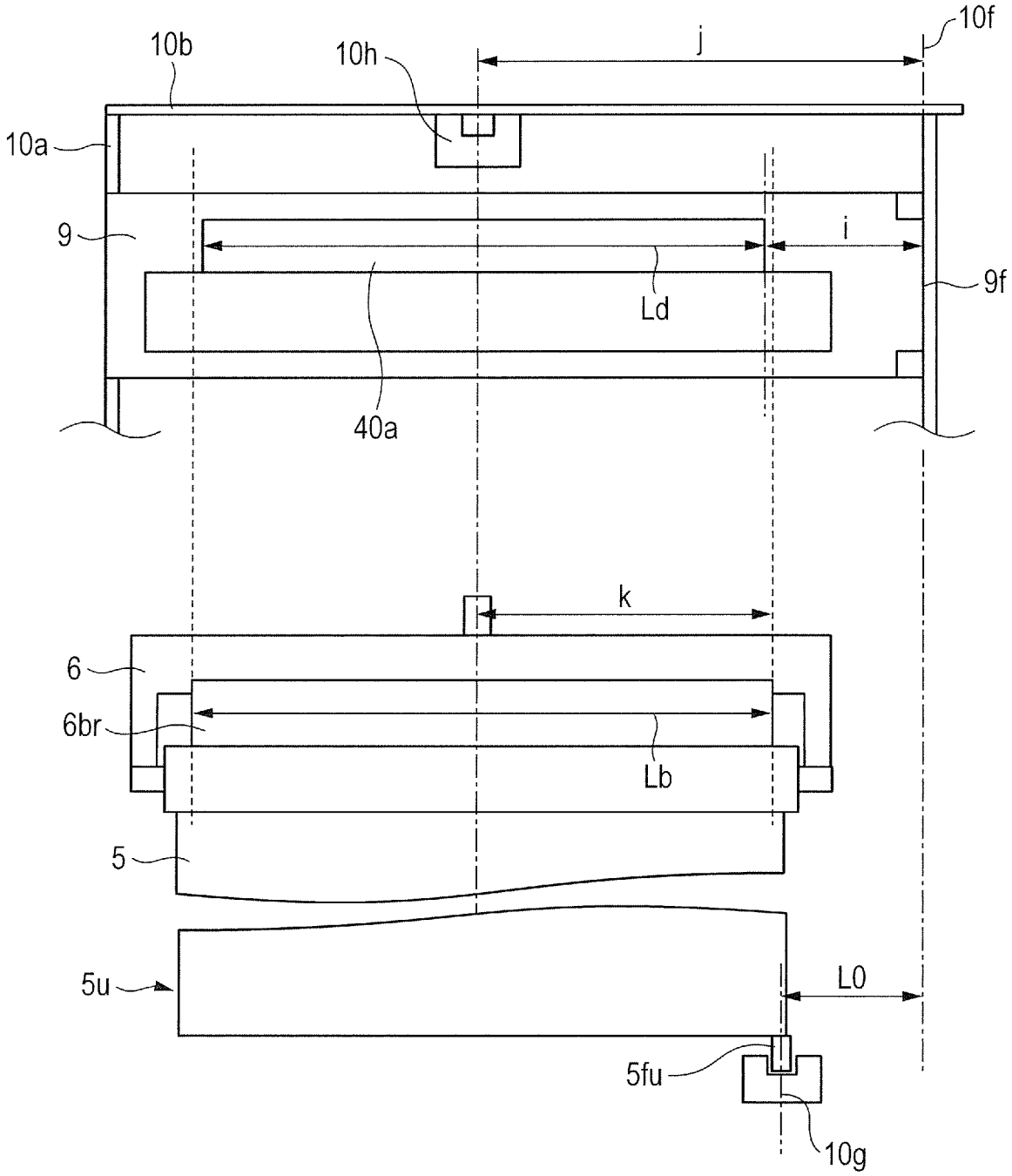
FIG. 4 is a plan view for illustrating the relationship of the positioning portions for the image process unit, the intermediate transfer belt, and the belt cleaning device according to the first embodiment in more detail.

The cleaning unit 6 is assembled to the intermediate transfer unit 5*u* so as to be relatively movable in the longitudinal direction of the cleaning brush 6*br*. That is, as illustrated in FIG. 4, the cleaning unit 6 is arranged opposed to the support roller 52, which is configured to support the intermediate transfer belt 5, at one end side in the conveyance direction of the intermediate transfer belt 5. The cleaning unit 6 includes a casing 6*c* configured to retain the cleaning brush 6*br*, and both end portions of the casing 6*c* are supported coaxially with a rotary shaft of the opposed support roller 52 so as to be movable in the direction of the rotary shaft. Therefore, the cleaning unit 6 is roughly positioned in the longitudinal direction with respect to the intermediate transfer unit 5*u* when the cleaning unit 6 is present outside the apparatus main body 10.

Then, positioning of the cleaning brush 6*br* of the cleaning unit 6 in the longitudinal direction and positioning of the developing rollers 40*a* to 40*d* of the process cartridges 9 in the longitudinal direction are both performed with respect to the apparatus main body 10.

That is, the apparatus main body 10 includes a reference frame 10*f* configured to position the process cartridges 9 in the longitudinal direction through contact with rear end portions 9*f* of the process cartridges 9 on a far side in a mounting direction. On a left side frame 10*b* being a first frame orthogonal to the reference frame 10*f*, there is arranged a positioning portion 10*h*, which is a second positioning portion, configured to position the cleaning brush 6*br* of the cleaning unit 6 in the longitudinal direction.

Further, on a right side frame 10*c* being a second frame orthogonal to the reference frame 10*f*, there is arranged a positioning portion 10*g* configured to position the intermediate transfer unit 5*u* in a direction orthogonal to the reference frame 10*f*. With this, the intermediate transfer unit 5*u* and the cleaning unit 6 are positioned with respect to the reference frame 10*f* at different parts.

The reference frame 10*f* has a reference surface extending in a direction orthogonal to mounting and removing directions X of the process cartridges 9, that is, orthogonal to a roller shaft of the developing roller 40*a*. The process cartridges 9 pass through a front frame 10*a*, and the rear end portions 9*f* are brought into abutment against positioning portions 10*k* of the reference frame 10*f*. With this, the process cartridges 9 are positioned. The positioning portion 10*h* arranged on the left side frame 10*b* of the apparatus main body 10 is located at a center portion of the left side frame 10*b* with respect to the reference frame 10*f* as a reference. The cleaning unit 6 has a positioning protrusion 6*fu* which is a positioned portion to be engaged with the positioning portion 10*h* in a mounting direction Y of the intermediate transfer unit 5*u*. The positioning protrusion 6*fu* is arranged on the casing 6*c* configured to retain the cleaning brush 6*br*.

The positioning portion 10*g* arranged on the right side frame 10*c* of the apparatus main body 10 is arranged on one edge side of the intermediate transfer belt 5 with respect to the reference frame 10*f* as a reference. The intermediate transfer unit 5*u* has a positioning protrusion 5*fu* which is a positioned portion to be engaged with the positioning portion 10*g* in a mounting direction of the intermediate transfer unit 5*u*. The positioning protrusion 5*fu* is arranged on side plates 5*c* and 5*c* configured to support both ends of each of the support rollers 51 and 52 for the intermediate transfer belt 5 of the intermediate transfer unit 5*u*. Herein, the reference frame 10*f*, the right side frame 10*c*, and the left side frame 10*b* construct a frame unit portion 100.

With this, the support rollers 51 and 52 configured to support the intermediate transfer belt 5 of the intermediate transfer unit 5*u* are positioned in the longitudinal direction (roller shaft direction).

In FIG. 3A and FIG. 3B, the positioning portions 10*g* and 10*h* are illustrated only with the one-dot chain lines at positioning positions from the reference frame 10*f* serving as a reference. As illustrated in FIG. 4, the positioning portions 10*g* and 10*h* are formed into shapes having grooves which allow the positioning protrusions 5*fu* and 6*fu* to be fitted, respectively, to position the cleaning brush 6*br* and the support rollers 51 and 52 for the intermediate transfer belt 5 in the longitudinal direction.

The positioning protrusions 6*fu* and 5*fu*, and the positioning portions 10*h* and 10*g* arranged on the left side frame 10*b* and the right side frame 10*c* of the apparatus main body 10 are arranged opposed to each other in the mounting and removing directions of the intermediate transfer unit 5*u* and the belt cleaning device. The positioning protrusions 5*fu* and 6*fu* arranged on the belt cleaning device and the intermediate transfer unit 5*u* are capable to be inserted and removed with respect to the positioning portions 10*h* and 10*g* on the apparatus main body 10 side in the mounting and removing directions of the intermediate transfer unit 5*u*.

Thus, concurrently with the operation of mounting and removing the intermediate transfer unit 5*u* together with the cleaning unit 6 to the apparatus main body in the second direction, the positioning protrusions 6*fu* and 5*fu* and the positioning portions 10*h* and 10*g* are engaged and disengaged with each other.

FIG. 4 is a schematic view for illustrating a positional relationship between the developing roller 40*a*, which is the developing member arranged in one process cartridge 9, and the cleaning brush roller 6*br* arranged in the cleaning unit 6 for the intermediate transfer belt 5.

As illustrated in FIG. 4, the longitudinal width Ld of the developing roller 40*a* arranged in the process cartridge 9 and the longitudinal width Lb of the cleaning brush 6*br* arranged in the cleaning unit 6 are determined regardless of the position of the intermediate transfer unit 5*u*.

That is, it is only necessary that Lb be set to a minimum width within the range satisfying Ld<Lb in consideration of dimensional tolerances in inter-component dimensions i, j, and k in FIG. 4, which may occur in the process cartridge 9 and the cleaning unit 6. With this, downsizing of the cleaning brush 6*br* can be achieved.

Herein, the dimension i is a dimension from a far end wall of the process cartridge 9, which is brought into abutment against the reference frame 10*f* as a reference, to a far end of the developing roller 40*a*. The dimension j is a dimension from the reference frame 10*f* as a reference to a center of the groove of the positioning portion 10*h* for the cleaning unit 6. The dimension k is a dimension from a center of the positioning protrusion 6*fu* of the cleaning unit 6 to one end of the cleaning brush 6*br*.

Meanwhile, the intermediate transfer unit 5*u* is positioned through abutment of the positioning protrusion 5*fu*, which is arranged in the intermediate transfer unit 5*u*, against the positioning portion 10*g* arranged at a position of a distance LO with respect to the reference frame 10*f* as a reference.

As described above, the cleaning unit 6 including the cleaning brush 6*br* is roughly positioned with respect to the intermediate transfer unit 5*u* in the longitudinal direction when the cleaning unit 6 is present outside the apparatus main body 10.

When the cleaning unit 6 is mounted to the apparatus main body 10, the cleaning brush 6*br* is directly positioned with respect to the apparatus main body 10 in the longitudinal direction without intermediation of the intermediate transfer belt 5, and hence is positioned with high accuracy with respect to the process cartridge 9 positioned with respect to the apparatus main body 10. With this, the developing roller 40 of the process cartridge 9 and the cleaning brush 6*br* of the cleaning unit 6 can be mounted with minimized tolerances and mounting errors of the positioning portions in the longitudinal direction.

With this, further downsizing of the cleaning brush 6*br* and the cleaning unit 6 can be achieved. As a result, space saving of the apparatus main body and downsizing of process parts can be achieved, thereby being capable of providing a small and inexpensive image forming apparatus to a user.

Second Embodiment

Figure 5A:
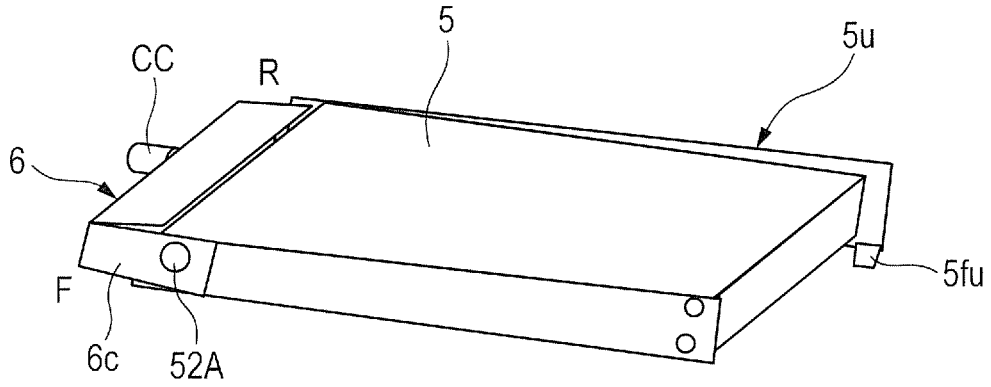
FIG. 5A is a schematic perspective view of a transfer unit according to a second embodiment of the present invention.
Figure 5B:
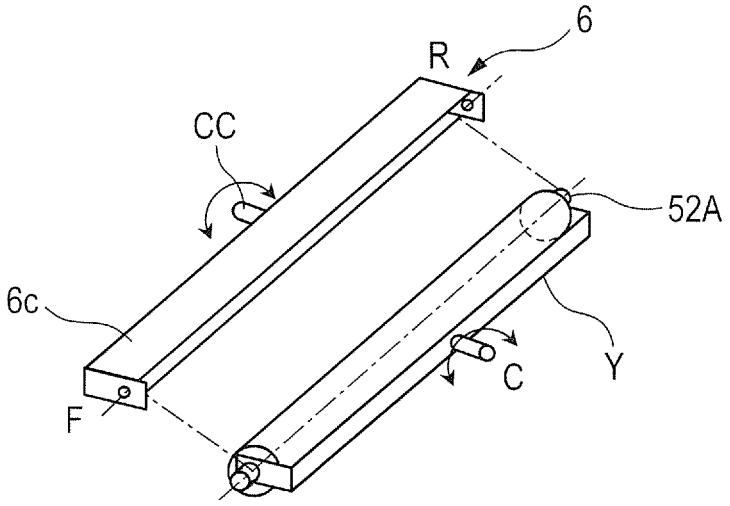
FIG. 5B is an exploded perspective view of a cleaning device and an alignment roller.
Figure 6:
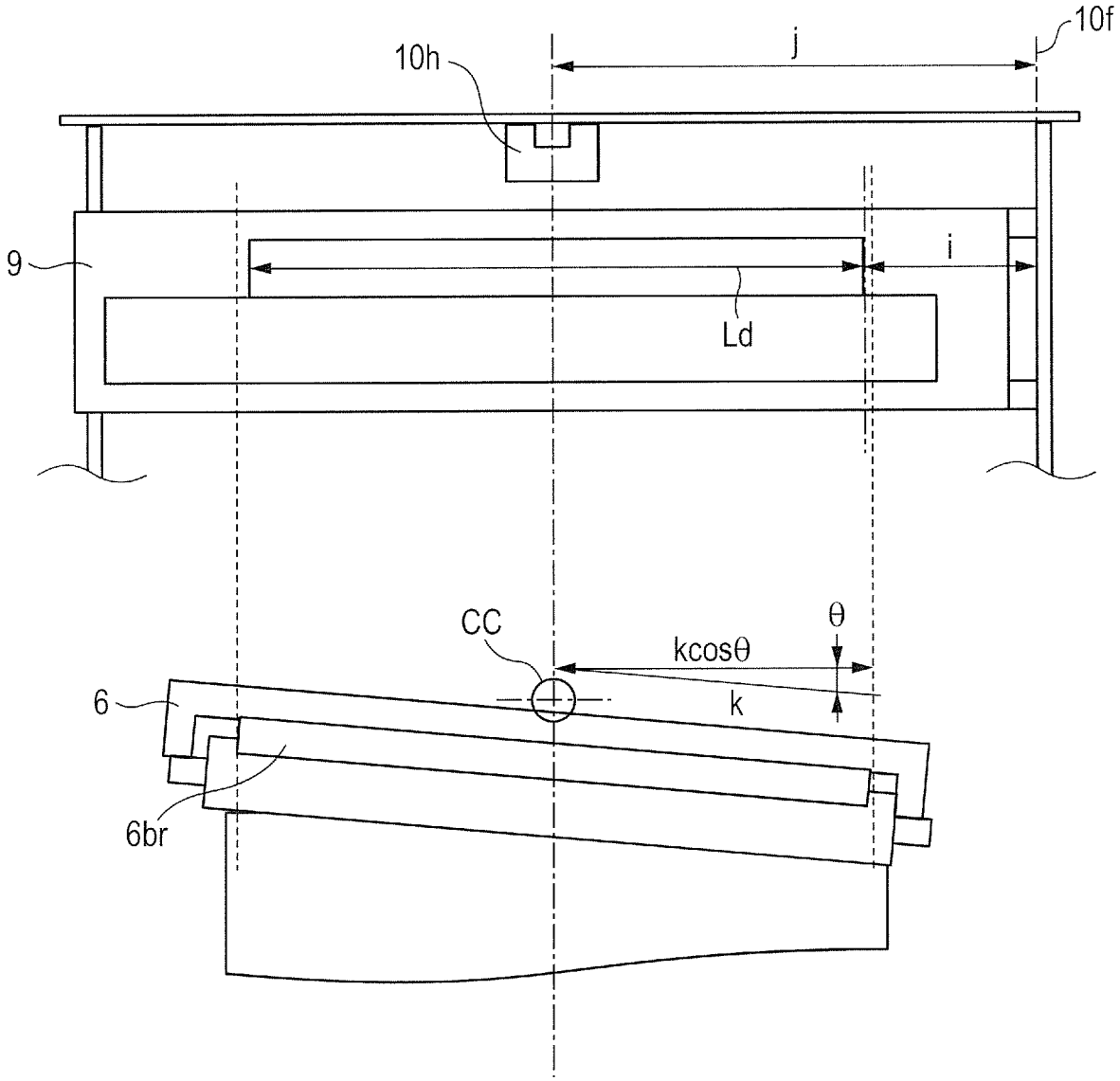
FIG. 6 is a plan view for illustrating a relationship of positioning portions for an image process unit, an intermediate transfer belt, and a belt cleaning device according to the second embodiment in more detail.

Next, description is made of an image forming apparatus according to a second embodiment of the present invention with reference to FIG. 5A, FIG. 5B, and FIG. 6.

In the second embodiment, the support roller 52, which is arranged at a position opposed to the cleaning unit to stretch the intermediate transfer belt 5, is an alignment roller 52A which can tilt with respect to the support roller 51 positioned at another end of the intermediate transfer unit 5*u*. The alignment roller 52A has a configuration in which a roller shaft thereof can tilt about a rotary center shaft C as a rotary fulcrum located in a midway of a roller shaft direction. The alignment roller 52A has a belt skew correcting function. The second embodiment is different from the above-mentioned first embodiment in that the cleaning unit 6 is mounted to the alignment roller 52A.

In the second embodiment, even when the alignment roller 52A is displaced in a tilting direction, fluctuation during the correction is not hindered. Further, positioning is performed with respect to the developing roller 40 so as to have a minimum relative displacement in the longitudinal direction, as in the first embodiment. That is, the cleaning brush 6*br* is positioned with respect to the apparatus main body 10 regardless of the position of the intermediate transfer belt 5. With this, the longitudinal width of the cleaning brush 6*br*, which is a key component for cleaning, is set to a minimum width in consideration of maximum displacement or the tolerances and mounting errors, thereby being capable of preventing occurrence of cleaning failure and achieving downsizing of the cleaning brush 6*br*.

In the following description, only the matters different from the first embodiment are mainly described. The components which are the same as those of the first embodiment are denoted by the same reference symbols, and description thereof is omitted.

First, the alignment roller 52A is described.

Figure 7:
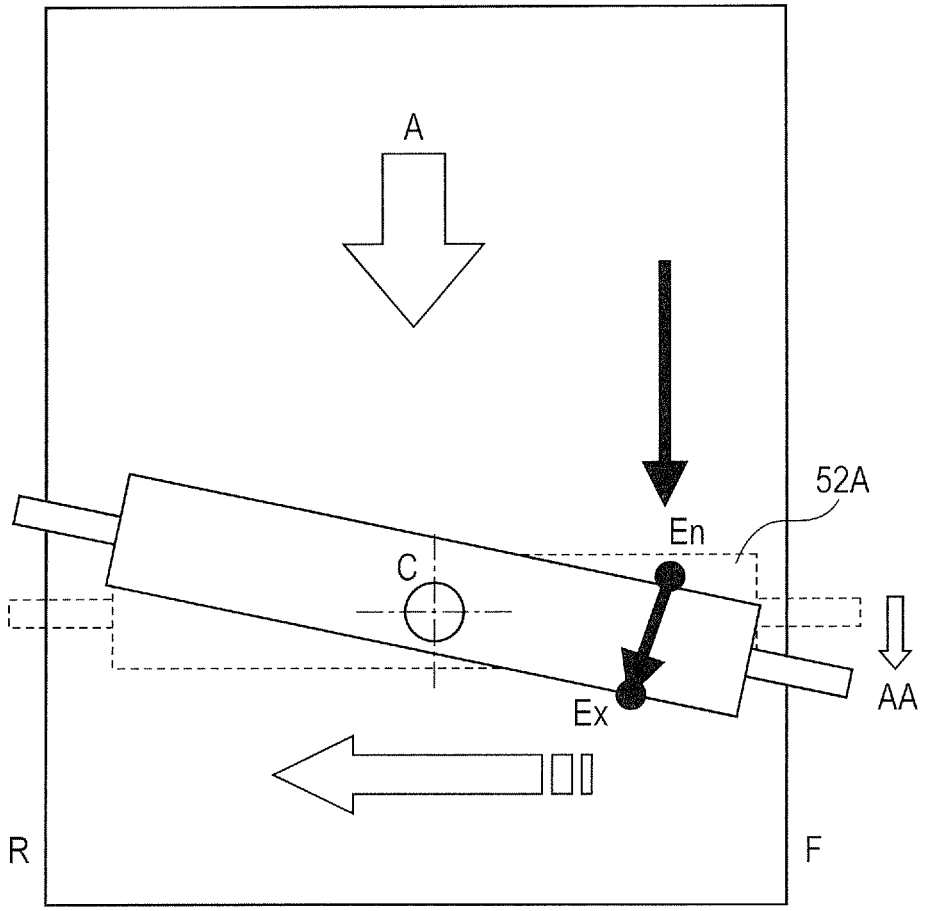
FIG. 7 is a schematic view for illustrating a state of correcting a belt skew in the transfer unit according to the second embodiment.

A rotary shaft of the alignment roller 52A is rotatably supported by a retaining member Y. The retaining member Y is retained with respect to a bearing portion (not shown), which is arranged in the apparatus main body, so as to be rotatable about the rotary center shaft C as a rotary fulcrum with respect to the intermediate transfer unit 5*u*. Further, at both end portions of the alignment roller 52A, there are arranged belt skew detection elements (not shown) such as edge sensors. When the intermediate transfer belt 5 skews toward the F-side (front side) as illustrated in FIG. 7 under certain conditions, a cam (not shown) is driven to cause the alignment roller 52A to turn in the direction AA about the rotary center shaft C.

With this, when the intermediate transfer belt 5 runs in the direction A, the alignment roller 52A moved in the direction AA causes the intermediate transfer belt 5 to run as follows. First, the intermediate transfer belt 5 advances with a certain phase En, and thereafter moves in a circumferential direction on the alignment roller 52A. Then, the intermediate transfer belt 5 passes through a phase Ex displaced toward the R-side (rear surface side) and is delivered.

As a result, when a shaft end of the alignment roller 52A is moved toward downstream in the direction AA with respect to a belt running direction, the intermediate transfer belt 5 skews toward the R-side (rear surface side). On the contrary, when the belt is moved toward upstream, the belt can skew to the F-side (front surface side). With this, even when the intermediate transfer belt 5 skews in one direction, highly tolerant lifetime can be achieved without excessive stress through abutment of the end portion against another member.

Next, the cleaning unit 6 is described.

The cleaning unit 6 is arranged at a position opposed to the alignment roller 52A. The cleaning unit 6 is supported substantially coaxially with the rotary shaft of the opposed alignment roller 52A so as to be movable in the longitudinal direction of the cleaning brush 6*br*. When the intermediate transfer unit 5*u* is mounted to the apparatus main body 10, the cleaning unit 6 is restricted in position with respect to the rotary shaft direction of the alignment roller 52A by a positioning shaft CC as a positioned portion, which is to be engaged with the positioning portion 10*h* of the apparatus main body 10. Herein, the positioning portion 10*h* is a first positioning portion. The rotary shaft direction of the alignment roller 52A is parallel to the longitudinal direction of the cleaning brush 6*br*.

The positioning portion 10*h*, as in the positioning portion 10*h* illustrated in FIG. 4, has a groove to which the positioning shaft CC is to be fitted. The positioning portion 10*h* is configured to position the cleaning unit 6 in the longitudinal direction and support the cleaning unit 6 so that the cleaning unit 6 is rotatable about the positioning shaft CC.

With this, even when the alignment roller 52A is tilted to adjust the alignment, the cleaning unit 6 does not hinder the movement of the alignment roller 52A.

Further, the positioning shaft CC is rotatably supported by the positioning portion 10*h*. Thus, the cleaning unit 6 turns about the positioning shaft CC with respect to the apparatus main body 10 in accordance with the tilt of the alignment roller 52A. Thus, it is only necessary that Lb be set to a minimum width within the range satisfying $Ld<Lb$ in consideration of $k\cos\theta$ for a case of actuation by a maximum displacement angle $\theta$, in addition to dimensional tolerances in inter-component dimensions i, j, and k in FIG. 6, which may occur in the process cartridge 9 and the cleaning unit 6. With this, downsizing of the cleaning brush 6*br* can be achieved.

With the configuration described above, space saving of the apparatus main body and downsizing of the process parts can be achieved, thereby being capable of providing a small, inexpensive, and highly tolerant image forming apparatus to the user.

In the first embodiment and the second embodiment described above, there is exemplified the mode in which the cleaning brush is arranged as the cleaning member in the cleaning unit 6. However, the cleaning member is not limited to the cleaning brush. Even when a cleaning roller capable of controlling toner polarity or a cleaning blade capable of mechanically scraping off toner is used in place of the cleaning brush, the minimum width can be achieved with a similar configuration.

Further, in each of the embodiments described above, the intermediate transfer unit is described as an example of the transfer unit. However, the present invention is also applicable to a conveyance transfer unit including a conveyance belt configured to convey a transfer material. That is, the present invention is applicable to a transfer unit including a belt configured to transfer a toner image from the photosensitive drum 1 serving as an image bearing member onto the transfer material P.

Further, in each of the embodiments described above, the process cartridges 9 serving as the image forming units are directly positioned with respect to the apparatus main body 10. However, the positioning may also be performed through positioning of the developing rollers 40, which are arranged in the process cartridges 9, in the longitudinal direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-256688, filed Dec. 28, 2015, which is hereby incorporated by reference herein in its entirety.

What is claimed is:

1. An image forming apparatus, comprising:

an apparatus main body;

a cartridge removably mountable to the apparatus main body and including a photosensitive drum configured to bear a toner image;

a transfer unit removably mountable to the apparatus main body and including a belt configured to transfer the toner image from the photosensitive drum onto a transfer material;

a cleaning unit removably mountable to the apparatus main body and supported by the transfer unit as the cleaning unit is mounted to and dismounted from the apparatus main body, and including a cleaning member configured to remove residual toner on the belt, the cleaning member positioned with respect to the cleaning unit in a longitudinal direction of the cleaning member; and a frame unit portion having a reference frame to position the cartridge with regard to the apparatus main body, and a first frame configured to engage the cleaning unit to position the cleaning unit with regard to the apparatus main body in an axial direction of the photosensitive drum in a case where the transfer unit is attached to the apparatus main body, the first frame connected to the reference frame, wherein the first frame includes a first positioning portion which is engageable with a positioned portion of the cleaning unit, and the cleaning member is positioned with respect to the apparatus main body in the axial direction through engagement of the positioned portion of the cleaning unit with the first positioning portion in a state where the transfer unit is mounted to the apparatus main body, and wherein the positioned portion of the cleaning unit comprises a positioning shaft, and the cleaning unit is rotatably supported in a state in which the positioning shaft is engaged with the first positioning portion.

2. An image forming apparatus according to claim 1, wherein the frame unit portion includes a second frame to position the transfer unit with regard to the apparatus main body in a case where the transfer unit is attached to the apparatus main body, the second frame connected to the reference frame.

3. An image forming apparatus according to claim 2, wherein the second frame extends in a direction orthogonal to a direction in which the reference frame extends, and the second frame includes a second positioning portion which is engageable with a positioned portion of the transfer unit, and the transfer unit is positioned with respect to the apparatus main body by engaging the positioned portion of the transfer unit with the second positioning portion.

4. An image forming apparatus according to claim 1, wherein the positioned portion of the cleaning unit is inserted and removed with respect to the first positioning portion of the first frame in a mounting direction of the transfer unit.

5. An image forming apparatus according to claim 1, wherein the reference frame is configured to position the cartridge with respect to the apparatus main body in the axial direction through abutment of a rear end portion of the cartridge on a far side in a mounting direction of the cartridge.

6. An image forming apparatus according to claim 1, wherein the cartridge is removably insertable into the apparatus main body in a first direction parallel to the axial direction, and wherein the transfer unit is removably insertable, together with the cleaning unit, into the apparatus main body in a second direction orthogonal to the first direction and along a running surface of the belt.

7. An image forming apparatus according to claim 1, further comprising a support roller provided in a position in which the support roller opposes the cleaning unit, the support roller configured to support the belt, on one end side of a conveyance direction of the belt, wherein the cleaning unit is supported coaxially with a rotary shaft of the support roller opposed thereto so as to be movable in a rotary shaft direction, and is restricted in position with respect to the rotary shaft direction of the support roller in a state where the transfer unit is mounted to the apparatus main body.

8. An image forming apparatus according to claim 7, further comprising another support roller provided on another end side of the conveyance direction of the belt, the other support roller configured to support the belt with the support roller;

wherein the support roller is capable of tilting with respect to the other support roller about a rotary fulcrum, which is positioned in a midway of the support roller, as a rotary center.

9. An image forming apparatus according to claim 1, wherein the cartridge includes a developing roller configured to supply toner to the photosensitive drum, and the developing roller is positioned with respect to the apparatus main body in the axial direction by positioning the cartridge with respect to the apparatus main body in the axial direction.

10. An image forming apparatus according to claim 1, wherein the transfer unit includes an intermediate transfer belt as the belt.

11. An image forming apparatus according to claim 1, wherein the cleaning unit is positioned with respect to the transfer unit in the longitudinal direction when the transfer unit is mounted to the apparatus main body, and is movable with respect to the transfer unit in the longitudinal direction when the transfer unit is not mounted to the apparatus main body.

12. An image forming apparatus according to claim 1, wherein the cartridge includes a drum cleaning member contacting the photosensitive drum, the drum cleaning member configured to remove residual toner on the photosensitive drum, wherein residual toner on the belt is electrostatically adhered onto the photosensitive drum from the belt and collected by the drum cleaning member after the cleaning member controls a toner polarity.

13. An image forming apparatus, comprising:

an apparatus main body;

a cartridge removably mountable to the apparatus main body and including a photosensitive drum configured to bear a toner image;

a transfer unit removably mountable to the apparatus main body and including a belt configured to transfer the toner image from the photosensitive drum onto a transfer material;

a cleaning unit removably mountable to the apparatus main body and supported by the transfer unit as the cleaning unit is mounted to and dismounted from the apparatus main body, and including a cleaning member configured to remove residual toner on the belt, the cleaning member positioned with respect to the cleaning unit in a longitudinal direction of the cleaning member;

a support roller provided in a position in which the support roller opposes the cleaning unit, the support roller configured to support the belt, on one end side of a conveyance direction of the belt;

another support roller provided on another end side of the conveyance direction of the belt, the other support roller configured to support the belt with the support roller; and a frame unit portion having a reference frame to position the cartridge with regard to the apparatus main body, and a first frame configured to engage the cleaning unit to position the cleaning unit with regard to the apparatus main body in an axial direction of the photosensitive drum in a case where the transfer unit is attached to the apparatus main body, the first frame connected to the reference frame, wherein the cleaning unit is supported coaxially with a rotary shaft of the support roller opposed thereto so as to be movable in a rotary shaft direction, and is restricted in position with respect to the rotary shaft direction of the support roller in a state where the transfer unit is mounted to the apparatus main body, and wherein the support roller is capable of tilting with respect to the other support roller about a rotary fulcrum, which is positioned in a midway of the support roller, as a rotary center.

14. An image forming apparatus according to claim 13, wherein the frame unit portion includes a second frame to position the transfer unit with regard to the apparatus main body in a case where the transfer unit is attached to the apparatus main body, the second frame connected to the reference frame.

15. An image forming apparatus according to claim 14, wherein the second frame extends in a direction orthogonal to a direction in which the reference frame extends, and the second frame includes a second positioning portion which is engageable with a positioned portion of the transfer unit, and the transfer unit is positioned with respect to the apparatus main body by engaging the positioned portion of the transfer unit with the second positioning portion.

16. An image forming apparatus according to claim 13, wherein the first frame includes a first positioning portion which is engageable with a positioned portion of the cleaning unit, and the cleaning member is positioned with respect to the apparatus main body in the axial direction through engagement of the positioned portion of the cleaning unit with the first positioning portion in a state where the transfer unit is mounted to the apparatus main body, and wherein the positioned portion of the cleaning unit is inserted and removed with respect to the first positioning portion of the first frame in a mounting direction of the transfer unit.

17. An image forming apparatus according to claim 13, wherein the cartridge is removably insertable into the apparatus main body in a first direction parallel to the axial direction, and wherein the transfer unit is removably insertable, together with the cleaning unit, into the apparatus main body in a second direction orthogonal to the first direction and along a running surface of the belt.

18. An image forming apparatus according to claim 13, wherein the cartridge includes a developing roller configured to supply toner to the photosensitive drum, and the developing roller is positioned with respect to the apparatus main body in the axial direction by positioning the cartridge with respect to the apparatus main body in the axial direction.

19. An image forming apparatus according to claim 13, wherein the transfer unit includes an intermediate transfer belt as the belt.

20. An image forming apparatus according to claim 13, wherein the cleaning unit is positioned with respect to the transfer unit in the longitudinal direction when the transfer unit is mounted to the apparatus main body, and is movable with respect to the transfer unit in the longitudinal direction when the transfer unit is not mounted to the apparatus main body.

21. An image forming apparatus according to claim 13, wherein the cartridge includes a drum cleaning member contacting the photosensitive drum, the drum cleaning member configured to remove residual toner on the photosensitive drum, wherein residual toner on the belt is electrostatically adhered onto the photosensitive drum from the belt and collected by the drum cleaning member after the cleaning member controls a toner polarity.

22. An image forming apparatus, comprising:

an apparatus main body;

a cartridge removably mountable to the apparatus main body and including a photosensitive drum configured to bear a toner image;

a transfer unit removably mountable to the apparatus main body and including a belt configured to transfer the toner image from the photosensitive drum onto a transfer material;

a cleaning unit removably mountable to the apparatus main body and supported by the transfer unit as the cleaning unit is mounted to and dismounted from the apparatus main body, and including a cleaning member configured to remove residual toner on the belt, the cleaning member positioned with respect to the cleaning unit in a longitudinal direction of the cleaning member; and a frame unit portion having a reference frame to position the cartridge with regard to the apparatus main body, and a first frame configured to engage the cleaning unit to position the cleaning unit with regard to the apparatus main body in an axial direction of the photosensitive drum in a case where the transfer unit is attached to the apparatus main body, the first frame connected to the reference frame, wherein the cartridge is removably insertable into the apparatus main body in a first direction parallel to the axial direction, and the transfer unit is removably insertable, together with the cleaning unit, into the apparatus main body in a second direction orthogonal to the first direction and along a running surface of the belt, and wherein when the cleaning unit and the transfer unit are not mounted to the apparatus main body, the cleaning unit is movably supported by the transfer unit, and wherein when the cleaning unit and the transfer unit are mounted to the apparatus main body, the cleaning unit is positioned with regard to the transfer unit, and is rotatably positioned to the first frame.

23. An image forming apparatus according to claim 22, wherein the frame unit portion includes a second frame to position the transfer unit with regard to the apparatus main body in a case where the transfer unit is attached to the apparatus main body, the second frame connected to the reference frame.

24. An image forming apparatus according to claim 23, wherein the second frame extends in a direction orthogonal to a direction in which the reference frame extends, and the second frame includes a second positioning portion which is engageable with a positioned portion of the transfer unit, and the transfer unit is positioned with respect to the apparatus main body by engaging the positioned portion of the transfer unit with the second positioning portion.

25. An image forming apparatus according to claim 22, wherein the first frame includes a first positioning portion which is engageable with a positioned portion of the cleaning unit, and the cleaning member is positioned with respect to the apparatus main body in the axial direction through engagement of the positioned portion of the cleaning unit with the first positioning portion in a state where the transfer unit is mounted to the apparatus main body.

26. An image forming apparatus according to claim 25, wherein the positioned portion of the cleaning unit is inserted and removed with respect to the first positioning portion of the first frame in a mounting direction of the transfer unit.

27. An image forming apparatus according to claim 25, wherein the positioned portion of the cleaning unit comprises a positioning shaft, and the cleaning unit is rotatably supported with regard to the transfer unit in a state in which the positioning shaft is engaged with the first positioning portion.

28. An image forming apparatus according to claim 22, further comprising a support roller provided in a position in which the support roller opposes the cleaning unit, the support roller configured to support the belt, on one end side of a conveyance direction of the belt, wherein the cleaning unit is supported coaxially with a rotary shaft of the support roller opposed thereto so as to be movable in a rotary shaft direction, and is restricted in position with respect to the rotary shaft direction of the support roller in a state where the transfer unit is mounted to the apparatus main body.

29. An image forming apparatus according to claim 28, further comprising another support roller provided on another end side of the conveyance direction of the belt, the other support roller configured to support the belt with the support roller;

wherein the support roller is capable of tilting with respect to the other support roller about a rotary fulcrum.

30. An image forming apparatus according to claim 22, wherein the cartridge includes a developing roller configured to supply toner to the photosensitive drum, and the developing roller is positioned with respect to the apparatus main body in the axial direction by positioning the cartridge with respect to the apparatus main body in the axial direction.

31. An image forming apparatus according to claim 22, wherein the transfer unit includes an intermediate transfer belt as the belt.

32. An image forming apparatus according to claim 22, wherein the cartridge includes a drum cleaning member contacting the photosensitive drum, the drum cleaning member configured to remove residual toner on the photosensitive drum, wherein residual toner on the belt is electrostatically adhered onto the photosensitive drum from the belt and collected by the drum cleaning member after the cleaning member controls a toner polarity.

* * * * *